US007124453B2

(12) United States Patent
Sun

(10) Patent No.: US 7,124,453 B2
(45) Date of Patent: Oct. 24, 2006

(54) CONNECTING DEVICE FOR CONNECTING A SHOWER HEAD ASSEMBLY TO A WALL-MOUNT WATER SUPPLYING PIPE

(76) Inventor: Tzu-Hsin Sun, Room C, 16F, No. 447, Sec. 3, Wen-Hsin Rd., Pei-Tun Dist., Taichung City (TW)

( * ) Notice: Subject to any disclaimer, the term of this patent is extended or adjusted under 35 U.S.C. 154(b) by 283 days.

(21) Appl. No.: 10/878,810

(22) Filed: Jun. 28, 2004

(65) Prior Publication Data

US 2005/0283903 A1 Dec. 29, 2005

(51) Int. Cl.
*E03C 1/04* (2006.01)

(52) U.S. Cl. ..... 4/675; 4/570; 4/615; 285/8

(58) Field of Classification Search ..... 4/570, 4/615, 675, 678; 285/8, 89, 137.11, 145.2
See application file for complete search history.

(56) References Cited

U.S. PATENT DOCUMENTS 3,979,096 A * 9/1976 Zieger ..... 248/75
5,385,533 A * 1/1995 Coviello ..... 601/165
6,588,031 B1 * 7/2003 Hecker ..... 4/675

* cited by examiner

*Primary Examiner*—Charles E. Phillips
(74) *Attorney, Agent, or Firm*—Ladas & Parry LLP

(57) ABSTRACT

A connecting device includes a tubular coupler which has an inner tubular wall that surrounds an axis and that engages a wall-mount water supplying pipe, a hollow adapter which has a surrounding wall turnable relative to an outer tubular wall of the coupler about the axis, and an outlet port extending radially relative to the axis for coupling with a shower head assembly, and a retaining member which is disposed to be kept in slidable contact with an end wall of the coupler so as to prevent removal of the adapter from the coupler.

10 Claims, 7 Drawing Sheets

CONNECTING DEVICE FOR CONNECTING A SHOWER HEAD ASSEMBLY TO A WALL-MOUNT WATER SUPPLYING PIPE

BACKGROUND OF THE INVENTION

1. Field of the Invention

This invention relates to a connecting device for a shower head assembly, more particularly to a connecting device for connecting a shower head assembly to a wall-mount water supplying pipe.

2. Description of the Related Art

Referring to FIG. 1, a conventional adapter 1 for connecting a shower head assembly 3 to a wall-mount water supplying pipe 2 is shown to have an internally threaded surface 101 which engages threadedly an externally threaded surface 201 of the pipe 2, and an outlet port 103 which extends radially of the pipe 2. A tubular connector 102 is disposed to fluidly communicate the outlet port 103 with a hose 301 of the shower head assembly 3. However, in assembly, since the outlet port 103 is turned with the screwing of the internally threaded surface 101 to the externally threaded surface 201, the outlet port 103 and the tubular connector 102 may not be positioned at a predetermined lower position parallel to the wall, thereby adversely affecting the appearance. In order to position the outlet port 103 at the predetermined lower position, the internally threaded surface 101 is not fully engaged with the externally threaded surface 201, thereby resulting in a clearance therebetween and leakage of water through the clearance.

SUMMARY OF THE INVENTION

The object of the present invention is to provide a connecting device for connecting a shower head assembly to a wall-mount water supplying pipe. The connecting device has an adapter turnable relative to the wall-mount water supplying pipe and coupling with the shower head assembly so as to keep an outlet port thereof at a predetermined lower position.

According to this invention, the connecting device includes a tubular coupler, a hollow adapter and a retaining member. The tubular coupler includes an inner tubular wall and an outer tubular wall which surround an axis and which are opposite to each other in radial directions, and has first and second tubular end walls which extend respectively and radially from the outer tubular wall to the inner tubular wall and which are opposite to each other in an axial direction parallel to the axis. The inner tubular wall defines a water duct therein which is adapted to be disposed downstream of a water supplying pipe to permit water flow from the second tubular end wall to the first tubular end wall. A hollow adapter has a surrounding wall which is disposed to surround and which is turnable relative to the outer tubular wall about the axis, and which includes outer and inner wall surfaces opposite to each other in radial directions, and an inner barrier wall which extends radially and inwardly from the inner wall surface and which confronts the first tubular end wall. The inner wall surface cooperates with the inner barrier wall to define a water passage which is disposed downstream of the water duct when the surrounding wall surrounds the outer tubular wall. The adapter has an outlet port which is disposed downstream of the water passage, and which extends in a radial direction relative to the axis so as to be adapted to couple with a shower head assembly. A retaining member is disposed to be distal from the inner barrier wall, and extends inwardly and radially from the inner wall surface and angularly along the inner wall surface about the axis. When the inner wall surface is turned relative to the outer tubular wall, the retaining member is kept in slidable contact with the second tubular end wall so as to prevent movement of the adapter away from the coupler along the axis.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
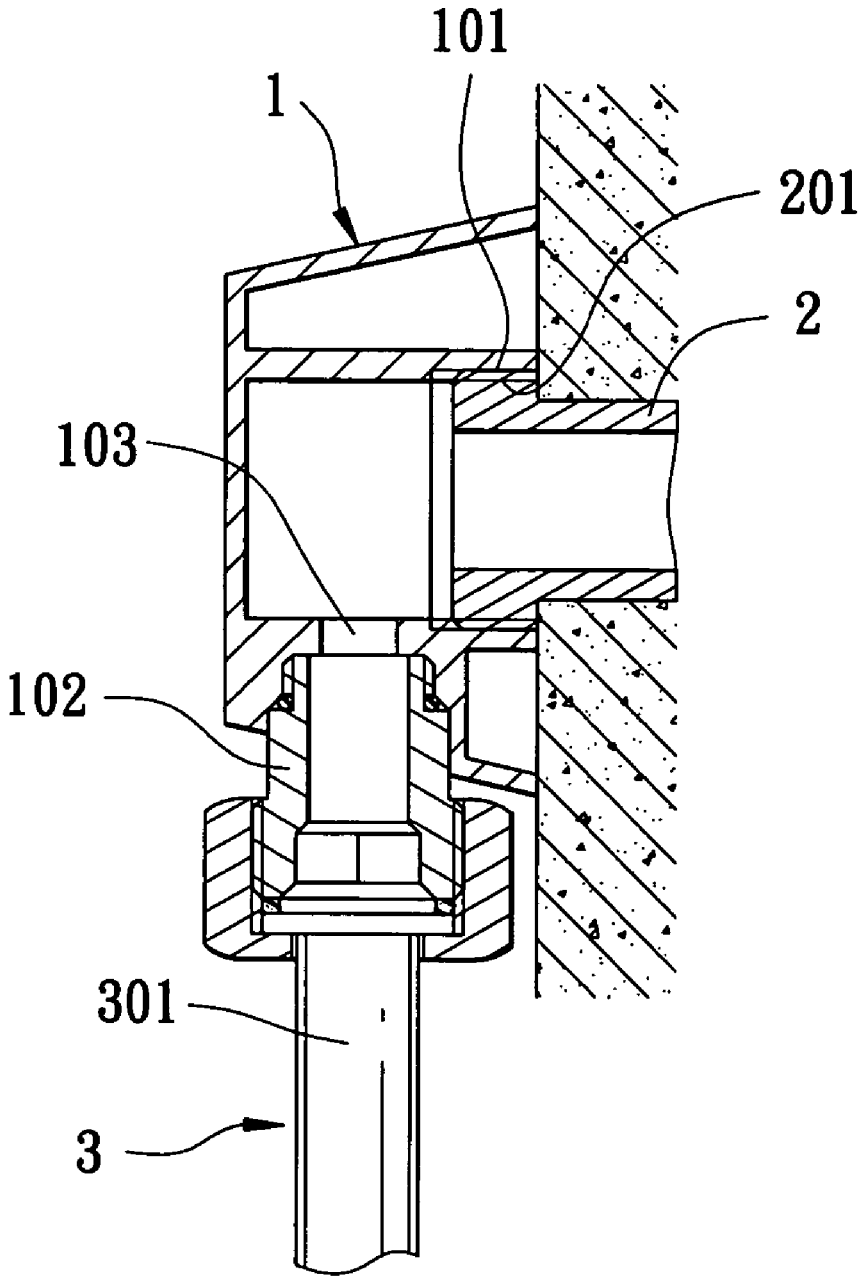
FIG. 1 PRIOR ART
FIG. 1 is a fragmentary sectional view of a conventional adapter for connecting a shower head assembly to a wall-mount water supplying pipe.

Before the present invention is described in greater detail, it should be noted that same reference numerals have been used to denote like elements throughout the specification.

Figure 2:
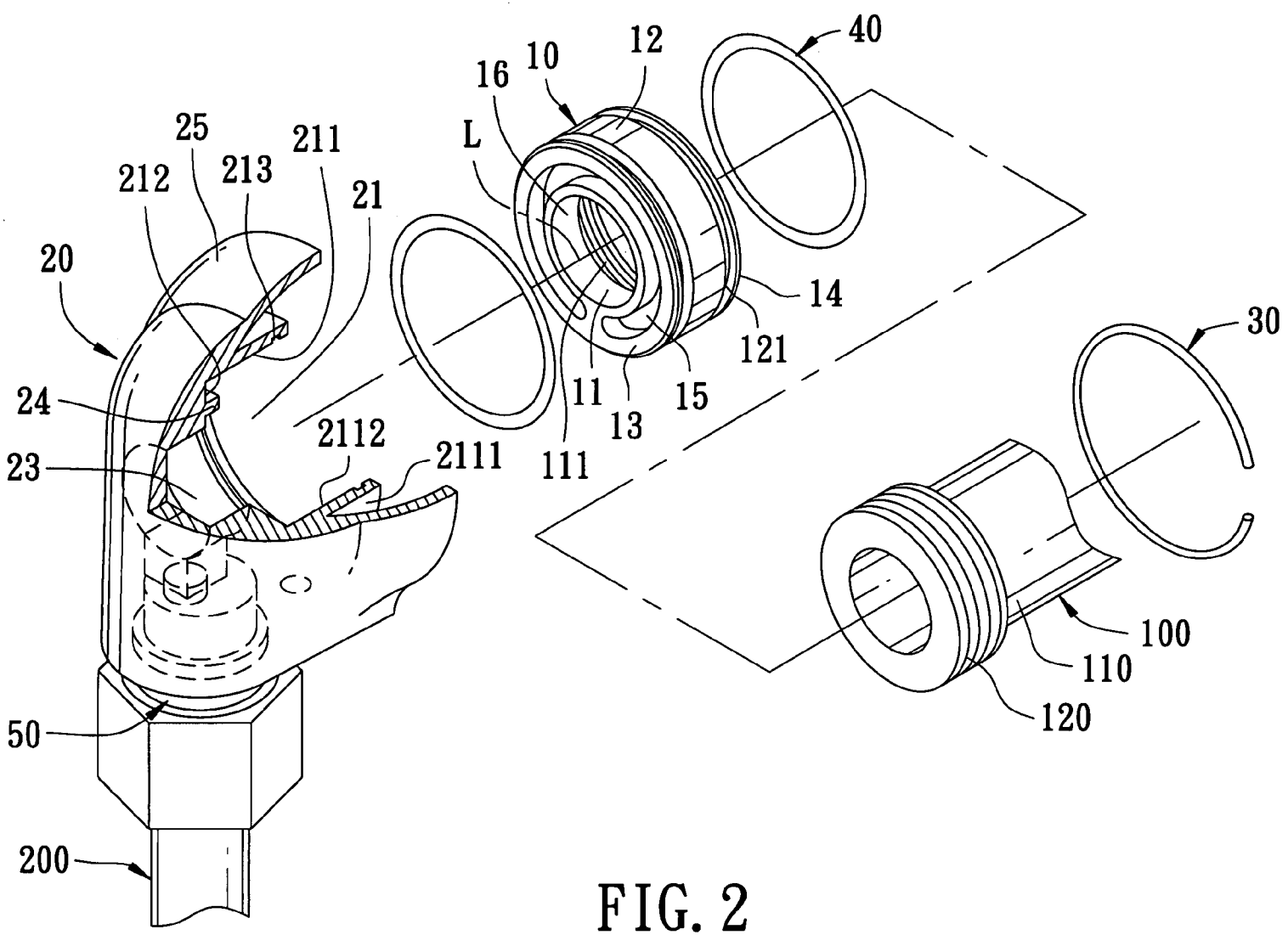
FIG. 2 is an exploded perspective view of a first preferred embodiment of a connecting device according to this invention for connecting a shower head assembly to a wall-mount water supplying pipe.
Figure 3:
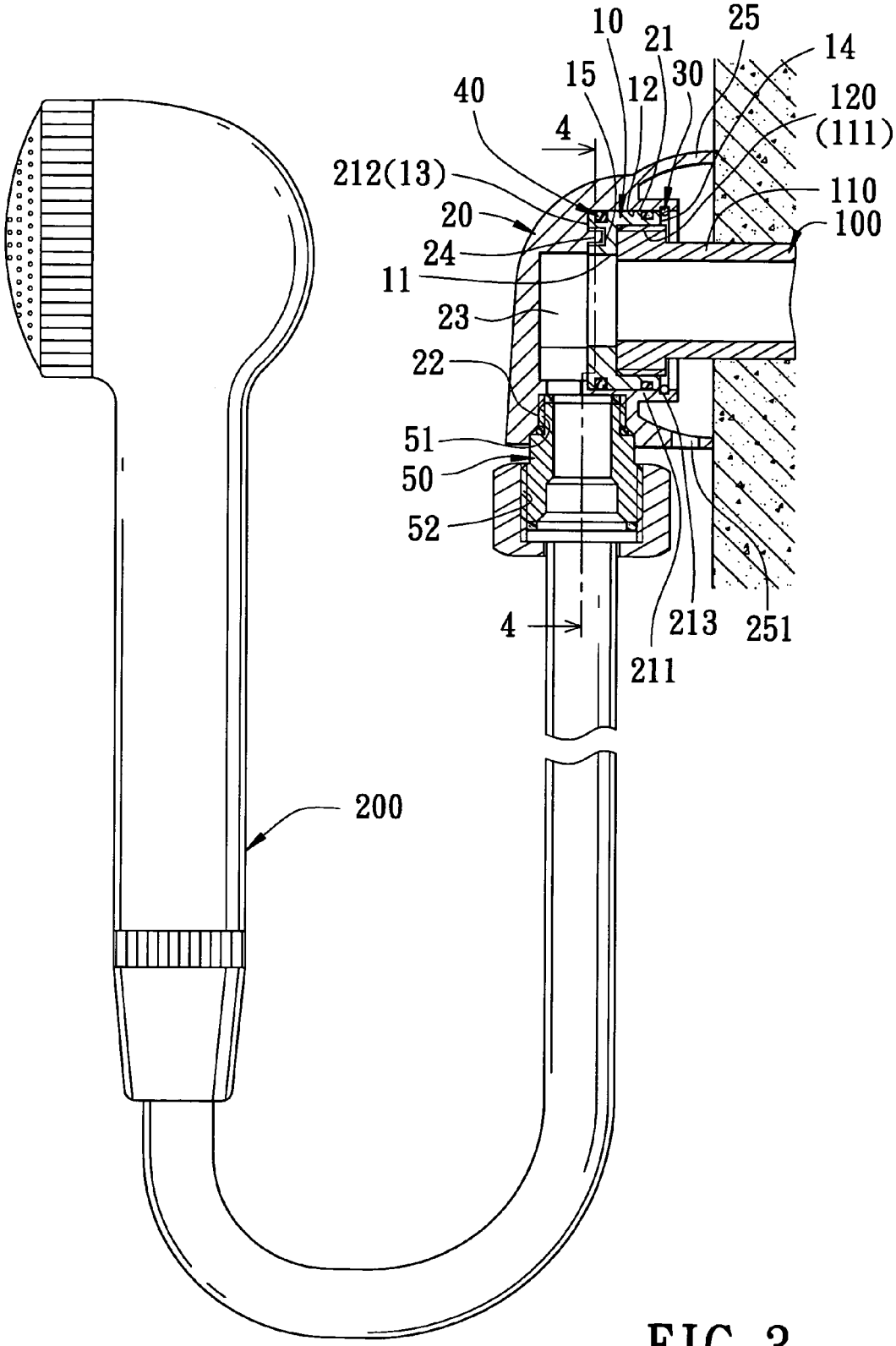
FIG. 3 is a sectional view showing the connecting device of the first preferred embodiment when assembled.

Referring to FIGS. 2 and 3, the first preferred embodiment of a connecting device for connecting a shower head assembly 200 to an outward portion 110 of a wall-mount water supplying pipe 100 according to the present invention is shown to comprise a tubular coupler 10, a hollow adapter 20, a retaining member 30, a water-tight seal member 40, and a tubular connecting member 50. The outward portion 110 of the water supplying pipe 100 has an externally threaded surface 120 formed thereon, and surrounds an axis (L) in an axial direction.

The tubular coupler 10 includes an inner tubular wall 11 and an outer tubular wall 12 which surround the axis (L) and which are opposite to each other in radial directions. The coupler 10 has first and second tubular end walls 13, 14 which extend respectively and radially from the outer tubular wall 12 to the inner tubular wall 11 and which are opposite to each other in the axial direction. The inner tubular wall 11 defines a water duct 16 therein, and has a threaded surface 111 which surrounds the axis (L) to engage threadedly the externally threaded surface 120 of the outward portion 110 so as to be disposed downstream of the water supplying pipe 100 to permit water flow from the second tubular end wall 14 to the first tubular end wall 13. Two annular grooves 121 are formed in the outer tubular wall 12 for engaging two seal rings of the water-tight seal member 40, respectively.

The adapter 20 has a surrounding wall 211 which is disposed to surround, and to be turnable relative to, the outer tubular wall 12 about the axis (L), and which includes outer and inner wall surfaces 2111, 2112 opposite to each other in radial directions, and an inner barrier wall 212 which extends radially and inwardly from the inner wall surface 2112 and which confronts the first tubular end wall 13. The inner wall surface 2112 cooperates with the inner barrier wall 212 to define a water passage 21 which is disposed downstream of the water duct 16 when the surrounding wall 211 surrounds the outer tubular wall 12 and is in water-tight engagement with the outer tubular wall 12 by means of the water-tight seal member 40 disposed therebetween. An intermediate chamber 23 is disposed downstream of and extends from the water passage 21 in the axial direction. An outlet port 22 is disposed downstream of and extends from the intermediate chamber 23 in a radial direction relative to the axis (L). The tubular connecting member 50 has a first threaded portion 51 which engages threadedly the outlet port 22, and a second threaded portion 52 which is opposite to the first threaded portion 51 in the radial direction and which engages threadedly the shower head assembly 200. A cover 25 is disposed to surround the surrounding wall 211, and has a through hole 251 formed in a lower portion thereof.

Moreover, the inner wall surface 2112 has an annular groove 213 which extends angularly about the axis (L) and which is disposed distal from the inner barrier wall 212. The retaining member 30 is a C-ring which is inserted into the annular groove 213, and which extends inwardly and radially from the annular groove 213 and angularly along the inner wall surface 2112 about the axis (L). Therefore, when the inner wall surface 2112 is turned relative to the outer tubular wall 12 of the coupler 10, the retaining member 30 is kept in slidable contact with the second tubular end wall 14 so as to prevent movement of the adapter 20 away from the coupler 10 along the axis (L).

Figure 4:
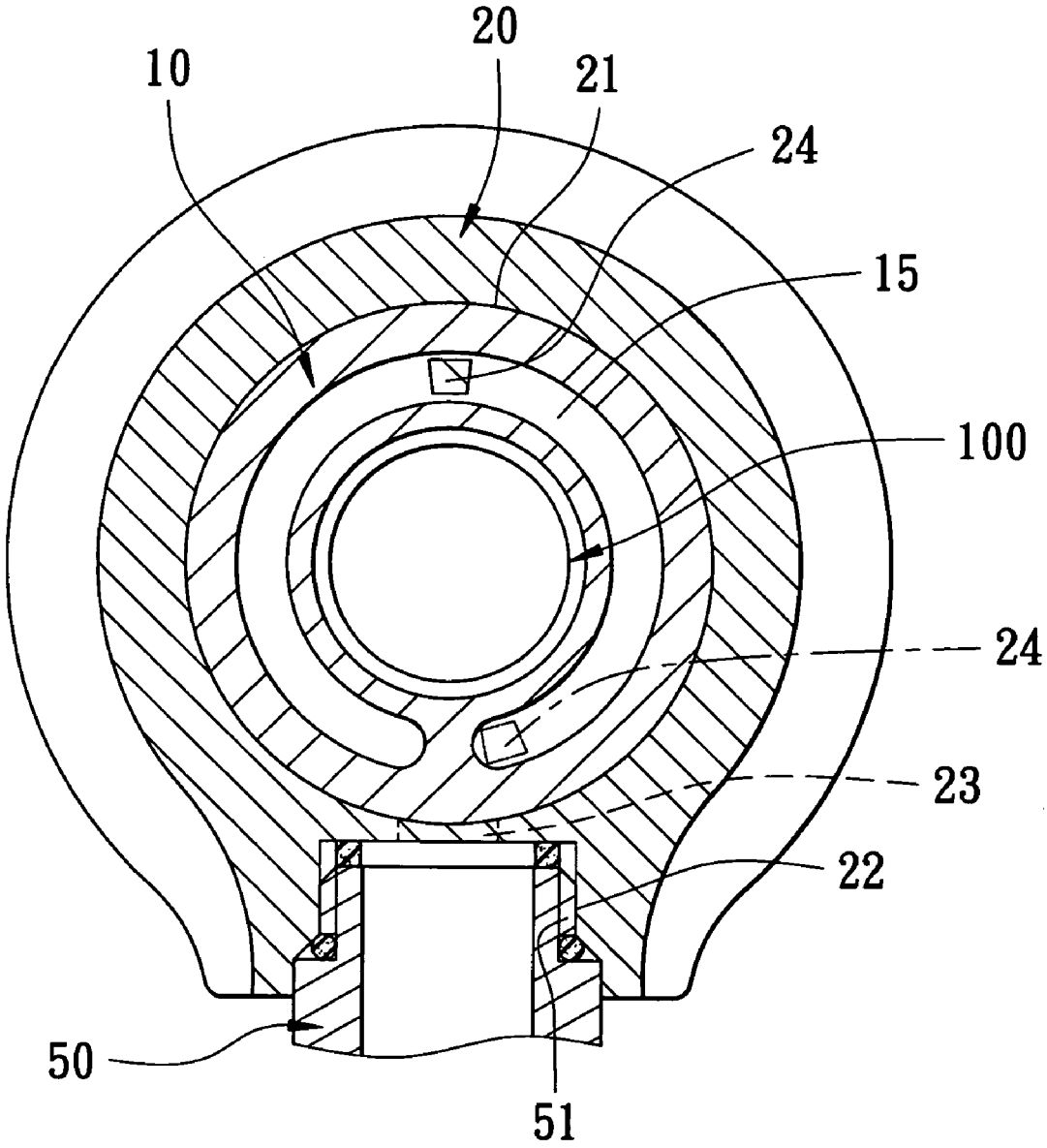
FIG. 4 is a partly sectional view of the connecting device taken along lines 4—4 of FIG. 3.

In addition, as shown in FIGS. 2 to 4, a keyway 15 is formed in the first tubular end wall 13 and extends angularly about the axis (L). A key 24 extends from the inner barrier wall 212 in the axial direction to be inserted into and to be guidingly movable along the keyway 15 so as to stabilize the turning of the surrounding wall 211 relative to the outer tubular wall 12 about the axis (L). Preferably, the keyway 15 extends angularly such that the guided movement of the key 24 spans an angle ranging from 270 to 350 degrees.

Figure 5:
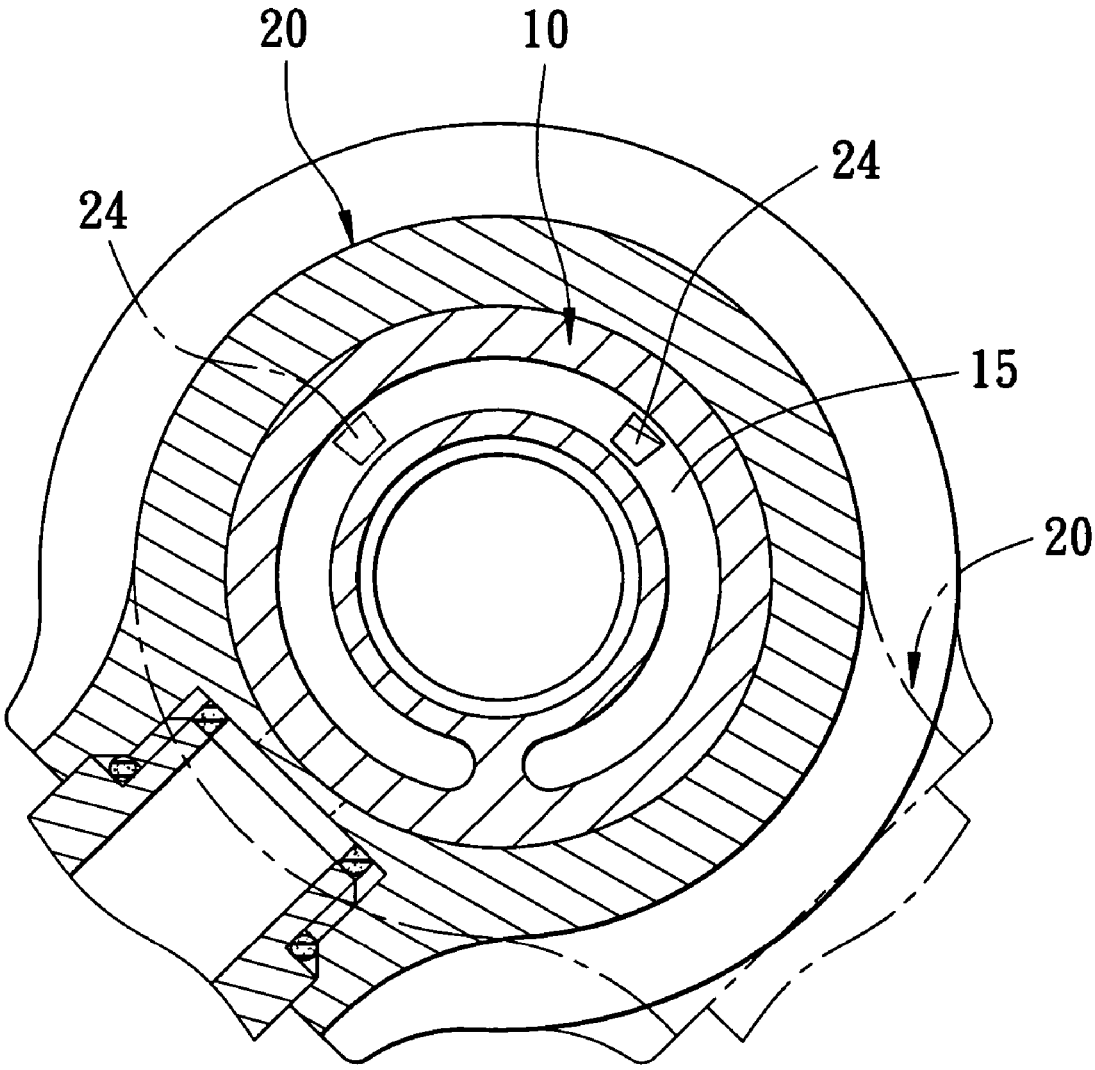
FIG. 5 is a partly sectional view similar to FIG. 4 with an adapter turned relative to a coupler.

In assembly, the key 24 is first inserted into the keyway 15, and the retaining member 30 is inserted into the annular groove 213 so as to retain the coupler 10 in the water passage 21. The threaded surface ill of the inner tubular wall 11 is then engaged with the externally threaded surface 120 of the water supplying pipe 100 to fasten tightly the coupler 10 to the pipe 100. Since the surrounding wall 211 of the adapter 20 is turnable relative to the outer tubular wall 12 of the coupler 10 about the axis (L), the outlet port 22 can be kept at a predetermined lower position after assembly. Besides, as shown in FIGS. 3 and 5, the shower head assembly 200 is turnable smoothly so as to result in convenience during use.

Figure 6:
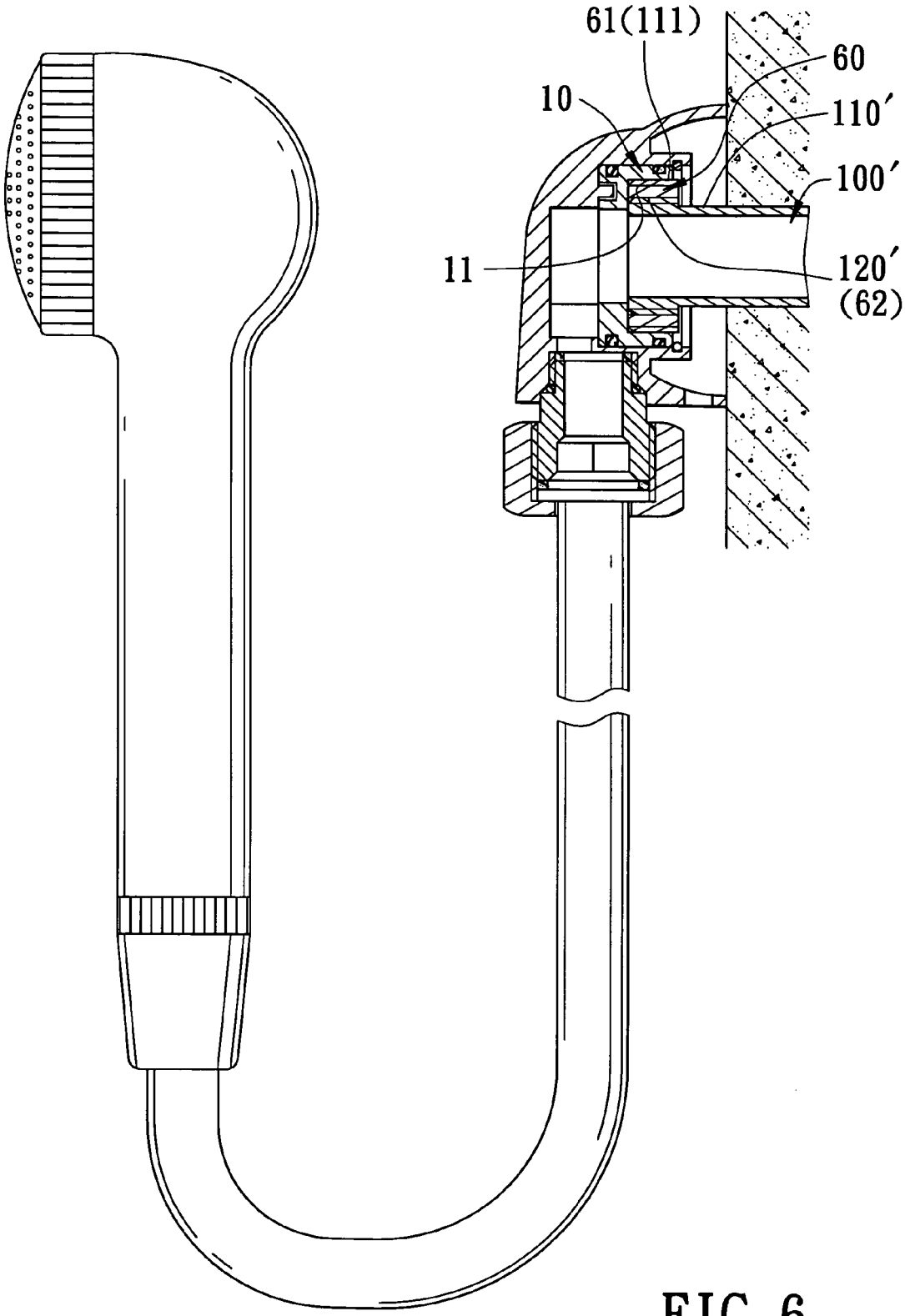
FIG. 6 is a sectional view of a second preferred embodiment of the connecting device according to this invention when assembled.

Referring to FIG. 6, the second preferred embodiment of the connecting device according to this invention is shown to be suitable for connection with a water supplying pipe 100' having a smaller diameter. The connecting device in this embodiment further comprises a bushing 60 which surrounds the axis and which is interposed between the inner tubular wall 11 and the outward portion 110' of the water supplying pipe 100'. The bushing 60 has internal and external frictional surfaces 62, 61 which are disposed opposite to each other in radial directions and which engage frictionally the threaded surface 120' of the outward portion 110' and the threaded surface 111 of the inner tubular wall 11 so as to fasten the coupler 10 to the water supplying pipe 100'.

Figure 7:
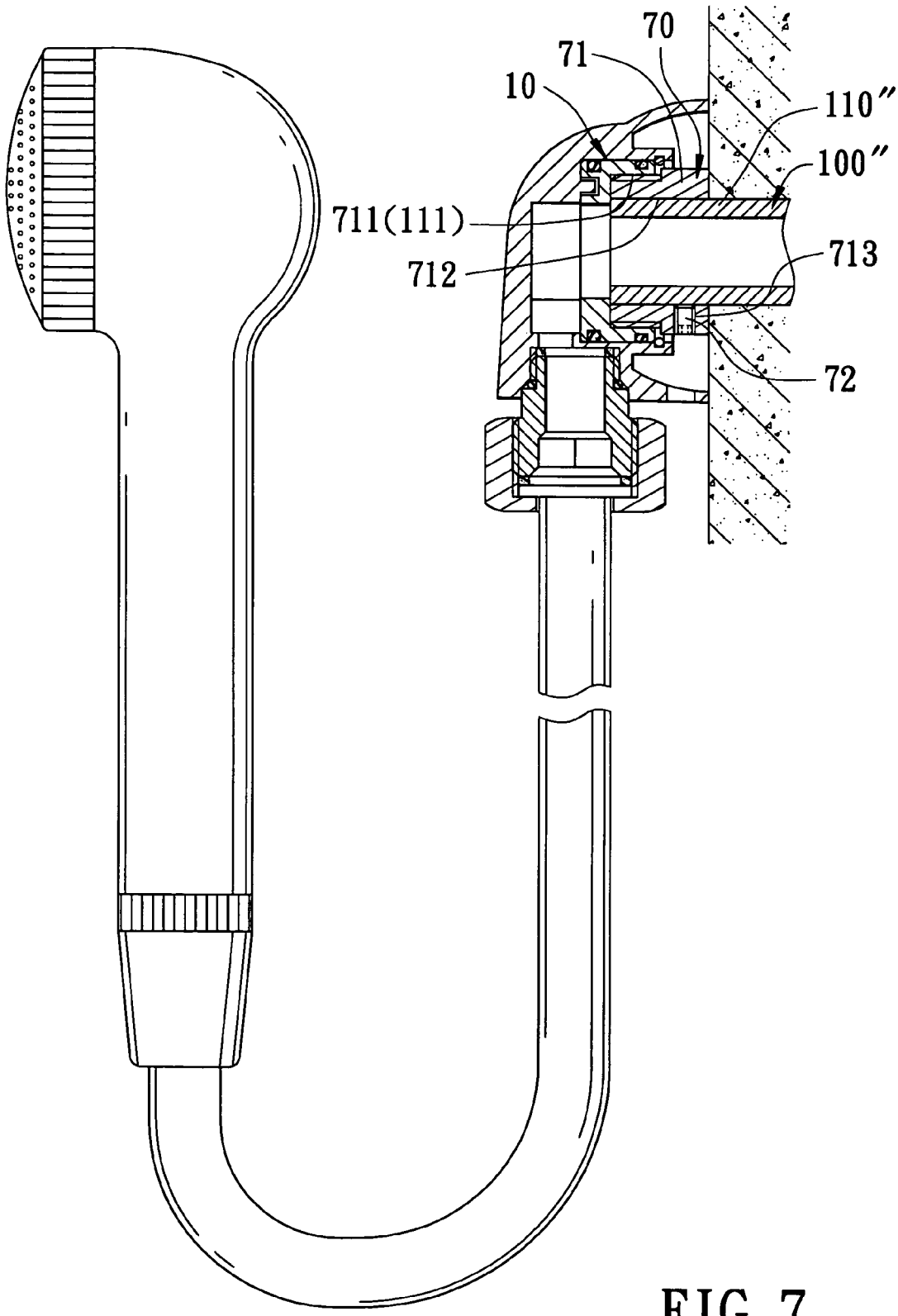
FIG. 7 is a sectional view of a third preferred embodiment of the connecting device according to this invention when assembled.

Referring to FIG. 7, the third preferred embodiment of the connecting device according to this invention is shown to be suitable for connection with a water supplying pipe 100" that is not formed with a threaded surface on the outward portion 110" thereof. In this embodiment, the connecting device further comprises a tightening unit 70, which includes a bushing 71 and a screw 72. The bushing 71 has an externally threaded surface 711 which surrounds the axis so as to engage threadedly the internally threaded surface 111 of the coupler 10, an inner surface 712 which is sleeved on the outward portion 110", and a screw hole 713 that extends in a radial direction through the inner surface 712. The screw 72 is disposed to engage threadedly the screw hole 713 so as to fasten the bushing 71 onto the water supplying pipe 100".

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A connecting device for connecting a shower head assembly to a wall-mount water supplying pipe, comprising:

a tubular coupler including an inner tubular wall and an outer tubular wall which surround an axis and which are opposite to each other in radial directions, and having first and second tubular end walls which extend respectively and radially from said outer tubular wall to said inner tubular wall and which are opposite to each other in an axial direction parallel to the axis, said inner tubular wall defining a water duct therein which is adapted to be disposed downstream of the water supplying pipe to permit water flow from said second tubular end wall to said first tubular end wall;

a hollow adapter having a surrounding wall which is disposed to surround and which is turnable relative to said outer tubular wall about the axis, and which includes outer and inner wall surfaces opposite to each other in radial directions, and an inner barrier wall which extends radially and inwardly from said inner wall surface and which confronts said first tubular end wall, said inner wall surface cooperating with said inner barrier wall to define a water passage which is disposed downstream of said water duct when said surrounding wall surrounds said outer tubular wall, said adapter having an outlet port which is disposed downstream of said water passage, and which extends in a radial direction relative to the axis so as to be adapted to couple with the shower head assembly; and a retaining member which is disposed to be distal from said inner barrier wall, and which extends inwardly and radially from said inner wall surface and angularly along said inner wall surface about the axis such that when said inner wall surface is turned relative to said outer tubular wall, said retaining member is kept in slidable contact with said second tubular end wall so as to prevent movement of said adapter away from said coupler along the axis.

2. The connecting device of claim 1, wherein said adapter further has an intermediate chamber disposed downstream of and extending from said water passage in the axial direction and which is in fluid communicated with said outlet port.

3. The connecting device of claim 2, wherein said inner wall surface has an annular groove which extends angularly about the axis, said retaining member being a ring which is inserted into said annular groove so as to be in slidable contact with said second tubular end wall.

4. The connecting device of claim 3, further comprising a water-tight seal member which is disposed between said outer tubular wall and said inner wall surface.

5. The connecting device of claim 4, further comprising a keyway which is formed in said first tubular end wall and which extends angularly about the axis, and a key which extends from said inner barrier wall in the axial direction to be inserted in and to be guidingly movable along said keyway so as to stabilize turning of said surrounding wall relative to said outer tubular wall about the axis.

6. The connecting device of claim 5, wherein said keyway extends angularly such that the guided movement of said key spans an angle ranging from 270 to 350 degrees.

7. The connecting device of claim 1, wherein said inner tubular wall has a threaded surface which surrounds the axis so as to be adapted to threadedly engage the water supplying pipe.

8. The connecting device of claim 1, further comprising a bushing which surrounds the axis and which is interposed between said inner tubular wall and the water supplying pipe so as to interconnect said coupler and the water supplying pipe.

9. The connecting device of claim 7, wherein said bushing has internal and external frictional surfaces which are disposed opposite to each other in radial directions and which engage frictionally the water supplying pipe and said inner tubular wall.

10. The connecting device of claim 7, wherein said bushing has an externally threaded surface that surrounds the axis, and a screw hole that extends in a radial direction therethrough, said connecting device further comprising a screw which is disposed to engage threadedly said screw hole so as to fasten said bushing onto the water supplying pipe, said inner tubular wall having an internally threaded surface which is disposed to engage threadedly said externally threaded surface of said bushing.

* * * * *